US007516854B2

(12) United States Patent
Brown et al.

(10) Patent No.: US 7,516,854 B2
(45) Date of Patent: Apr. 14, 2009

(54) SYSTEM BIN

(75) Inventors: Jerrold Brown, Medina, OH (US); Travis Shamp, Cuyahoga Falls, OH (US)

(73) Assignee: Akro-Mils, Inc., Akron, OH (US)

( * ) Notice: Subject to any disclaimer, the term of this patent is extended or adjusted under 35 U.S.C. 154(b) by 403 days.

(21) Appl. No.: 11/291,951

(22) Filed: Dec. 2, 2005

(65) Prior Publication Data

US 2007/0131632 A1 Jun. 14, 2007

(51) Int. Cl.
*A47F 3/14* (2006.01)

(52) U.S. Cl. ..... 211/126.13; 211/184; 211/126.2

(58) Field of Classification Search ..... 211/126.13, 211/126.12, 126.2, 126.4, 194, 184, 59.4; 206/507, 504, 509, 511, 512
See application file for complete search history.

(56) References Cited

U.S. PATENT DOCUMENTS 1,957,153 A * 5/1934 Smiley, Jr. ..... 211/126.12
RE24,731 E * 11/1959 Lockwood ..... 211/126.2
3,113,680 A 12/1963 Frater et al.
3,259,269 A * 7/1966 Asenbauer ..... 206/509
4,074,810 A * 2/1978 Juergens et al. ..... 211/11
4,573,577 A 3/1986 Miller
D295,932 S 5/1988 Cugley
D296,397 S 6/1988 Cugley
4,790,707 A 12/1988 Magretta et al.
4,852,749 A * 8/1989 Fernandez et al. ..... 211/126.2
5,036,990 A * 8/1991 Verchere ..... 211/85.29
D322,989 S 1/1992 Wood
5,492,399 A * 2/1996 Tillack ..... 312/111
5,531,517 A 7/1996 Alpen
6,595,378 B2 * 7/2003 Wang ..... 211/189
2001/0025824 A1 * 10/2001 Olivero ..... 211/74
2002/0063100 A1 * 5/2002 Kwang ..... 211/40
2003/0173396 A1 * 9/2003 Naughton et al. ..... 229/199
2004/0040923 A1 * 3/2004 Wolff ..... 211/194
2004/0084387 A1 * 5/2004 Chang ..... 211/11

(Continued)

OTHER PUBLICATIONS

Akro-Mils, Industrial & Commercial Products, Systems Bin (http://www.akro-mils.com/industrial/featured_display.asp), Nov. 16, 2005.

*Primary Examiner*—Jennifer E. Novosad
(74) *Attorney, Agent, or Firm*—Mattingly, Stanger, Malur & Brundidge, P.C

(57) ABSTRACT

A compartmented, stackable and nestable system bin includes a bottom having a rear wall, opposed end walls and a front wall integrally connected thereto. A plurality of spaced divider walls separate the bin into a plurality of compartments. A plurality of notches are formed in a top of each of the divider walls and the end walls and a plurality of grooves are formed in the underside or bottom of each of the compartments with sets of notches on the top of the bin being in vertical alignment with sets of grooves on the bottom of the compartments. The notches of a system bin receive a pair of dowels which support an upper system bin of identical construction when the upper system bin is in stacked relation thereon and the grooves of a system bin receive a pair of dowels positioned in notches on a lower system bin of identical construction when the system bin is in stacked relation on the lower system bin.

14 Claims, 5 Drawing Sheets

U.S. PATENT DOCUMENTS

2005/0082307 A1 4/2005 Tucker
2005/0087505 A1* 4/2005 Lukas ..... 211/40
2005/0194331 A1* 9/2005 Chang ..... 211/60.1
2005/0199564 A1* 9/2005 Johnson et al. ..... 211/59.3
2005/0199565 A1* 9/2005 Richter et al. ..... 211/59.3

* cited by examiner (TOP PLAN VIEW)

(BOTTOM PLAN VIEW)

SYSTEM BIN

BACKGROUND OF THE INVENTION

The present invention relates to system bin for holding articles and, more particularly, to a system bin which contains a plurality of compartments therein and which is both stackable and nestable in combination with another identical system bin.

It is common in many different work environments to utilize bins having a plurality of compartments to organize and store various items, particularly small and medium size items. Such work environments include manufacturing and assembly plants wherein various small parts such as fasteners and other mechanical parts used in the construction of machinery and the like. Other uses may be found in hardware and other retail stores where as much merchandise as possible is fitted into the available floor space. In such environments, it is also desirable to utilize system bins which may be securely stacked one upon another when in use and which may be nested one with in another when not in use such as when being stored or being shipped.

While many compartmented bins are available, there still exists a need for a durable bin having a plurality of compartments which may be nested with other identical bins when not in use and which may be securely stacked on other identical bins to form a system of bins when in use. There is a further need for such a compartmented, nestable and stackable bin which is simple and economical in construction and which may be molded of one piece.

BRIEF SUMMARY OF THE INVENTION

It is an object of the present invention to provide an improved system bin having a plurality of compartments and which may be stacked on other identical bins through the use of dowels between two bins.

A further object of the invention is to provide an improved system bin which may be stacked on other of such bins when in use and which may be nested within other identical bins when not in use.

Another object of the invention is to provide a system of bins whereby compartmented bins may be stacked one upon another and then securely held in place when in use.

The present invention achieves the above and other objects by providing a system bin having a bottom with a rear wall, first and second opposed end walls and a front wall integrally connected thereto. The bin contains a plurality of space divider walls extending between the front and rear walls to form a plurality of compartments. A plurality of notches are formed in the tops of the divider walls and each of the end walls and a plurality of grooves are formed in the underside of the compartments with the grooves being in vertical alignment with the notches. The notches receive a pair of dowels which support an upper system bin of identical construction when the upper system bin is in stacked relation on the system bin and the grooves receive a pair of dowels positioned in notches on a lower system bin of identical construction when the system bin is in stacked relation on the lower system bin. Each notch formed in the end walls has a retainer wall therein which prevents a dowel positioned in the notch from sliding longitudinally outwardly thereof.

Each of the compartments in a bin is narrower at the bottom than at the top whereby a plurality of identical system bins may be nested one within another when no dowels are present between the system bins. The system bin also may include slots in the side walls of each of the compartments and a partition wall may be mounted in the slots in each compartment to divide each compartment into a plurality of spaces. The partition wall may either be fixed or removable.

The present invention further includes a system of bins having at least an upper bin and a lower bin of identical construction to that described with respect to the system bin and wherein the system further includes a pair of dowels received in notches formed in the top of the lower bin and received in grooves formed on the bottom of the upper bin.

These and other features of the present invention will become more apparent with reference to the following detailed description of the drawings.

DETAILED DESCRIPTION OF THE INVENTION

The present invention provides an improved system bin and a system of bins wherein the bins each have a plurality of compartments and may be safely and securely stacked one upon another during use and which may be nested one within another when not in use.

Figure 1A:
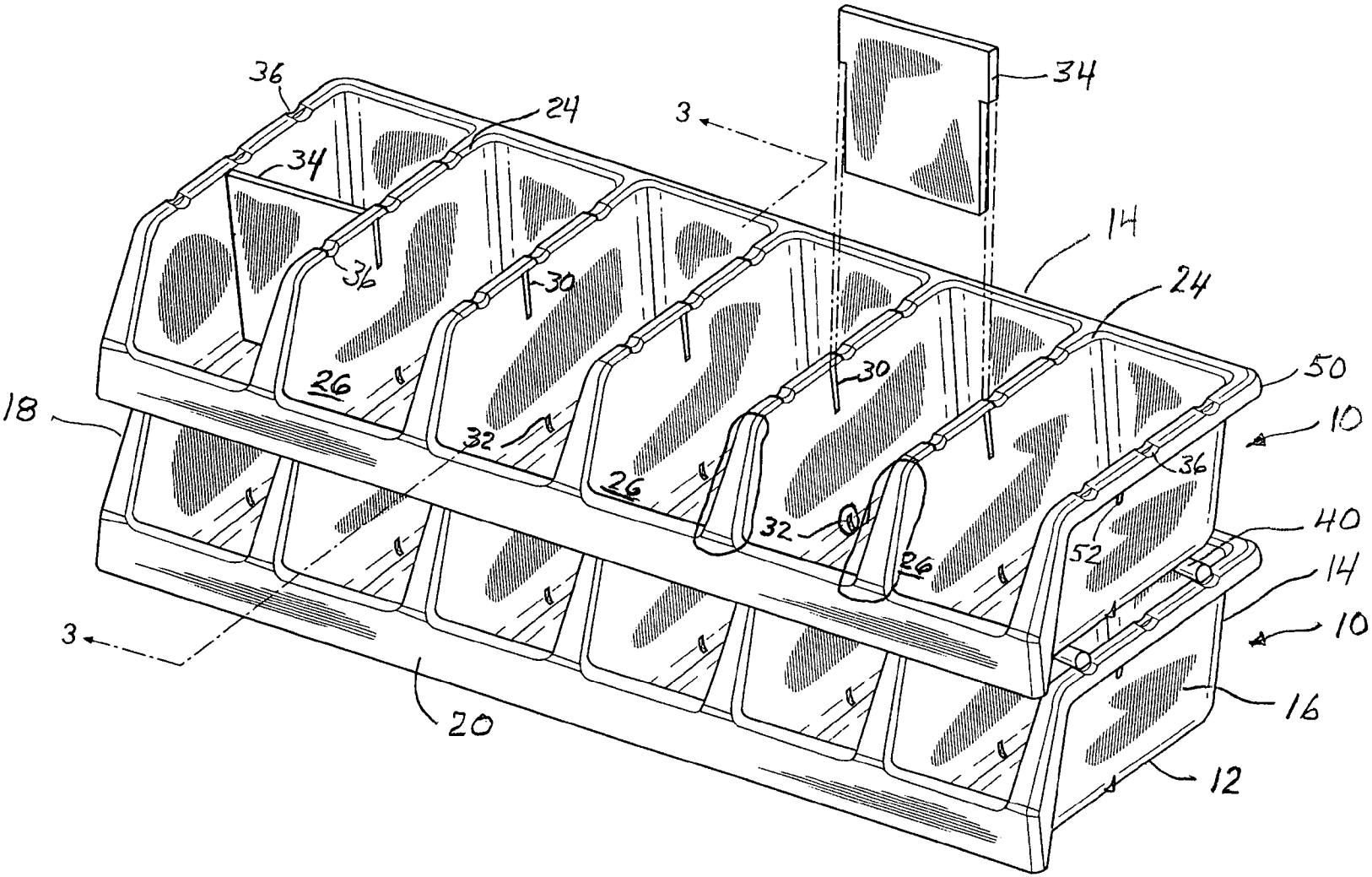
FIG. 1A is a front perspective view of a pair of system bins according to the present invention showing the two bins in stacked relation and illustrating removable divider walls in a plurality of compartments.

Shown in FIG. 1A are a pair of stacked system bins, with each bin generally being referred to by the numeral 10. Each system bin includes a bottom 12 having a rear wall 14, a first end wall 16, a second end wall 18 and a front wall 20 integrally connected thereto. The system bin is preferably molded in one piece of a suitable polyolefin plastic material such as polypropylene, polystyrene, or ABS. A bin made of this material is durable, waterproof, rustproof and corrosion proof. Moreover, a bin constructed of this material is resistant to cracking and breaking under normal load conditions.

Each system bin 10 further includes a plurality of spaced divider walls 24 extending between the rear wall 14 and the front wall 20 to divide the interior of the bin into a plurality of compartments 26. While six individual compartments are shown in the drawings, each system bin may be constructed having more or less than this number of compartments. A bin having six compartments, however, is convenient to handle and utilize.

Each divider wall 24 functions as a side wall for two adjacent compartments 26. Each side wall of each compartment is provided with a centrally located upper slot 30 and a lower slot 32 to receive a partition wall 34 therein as shown in FIG. 1A. Partition walls 34 may either be fixed in slots 30 and 32 or may be slidably retained therein so as to be removable. The partition walls 34 divide each compartment into a pair of spaces.

Figure 1B:
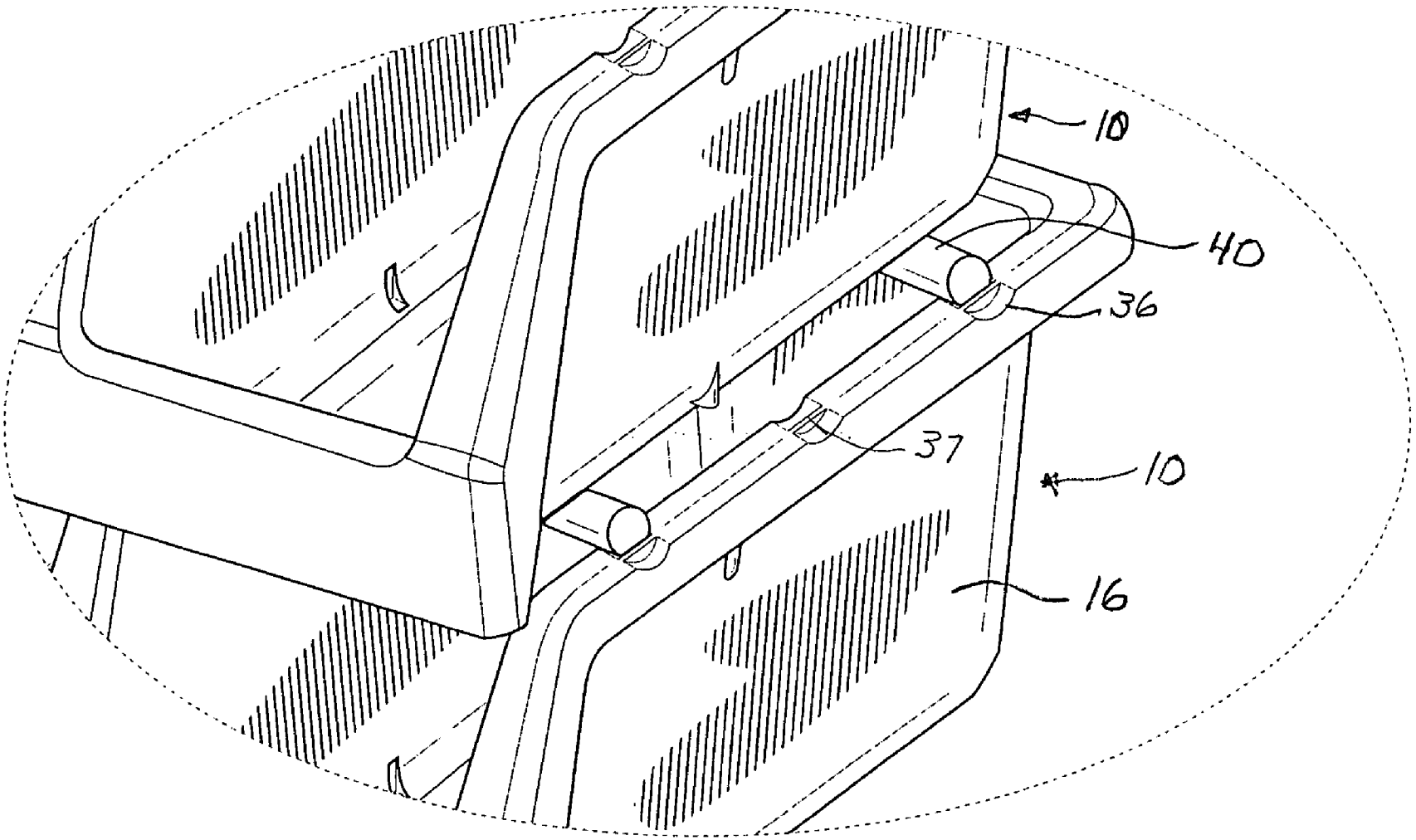
FIG. 1B is an enlarged view of the right hand end of the two stacked system bins shown in FIG. 1A, illustrating a pair of dowels mounted between the two system bins.
Figure 4:
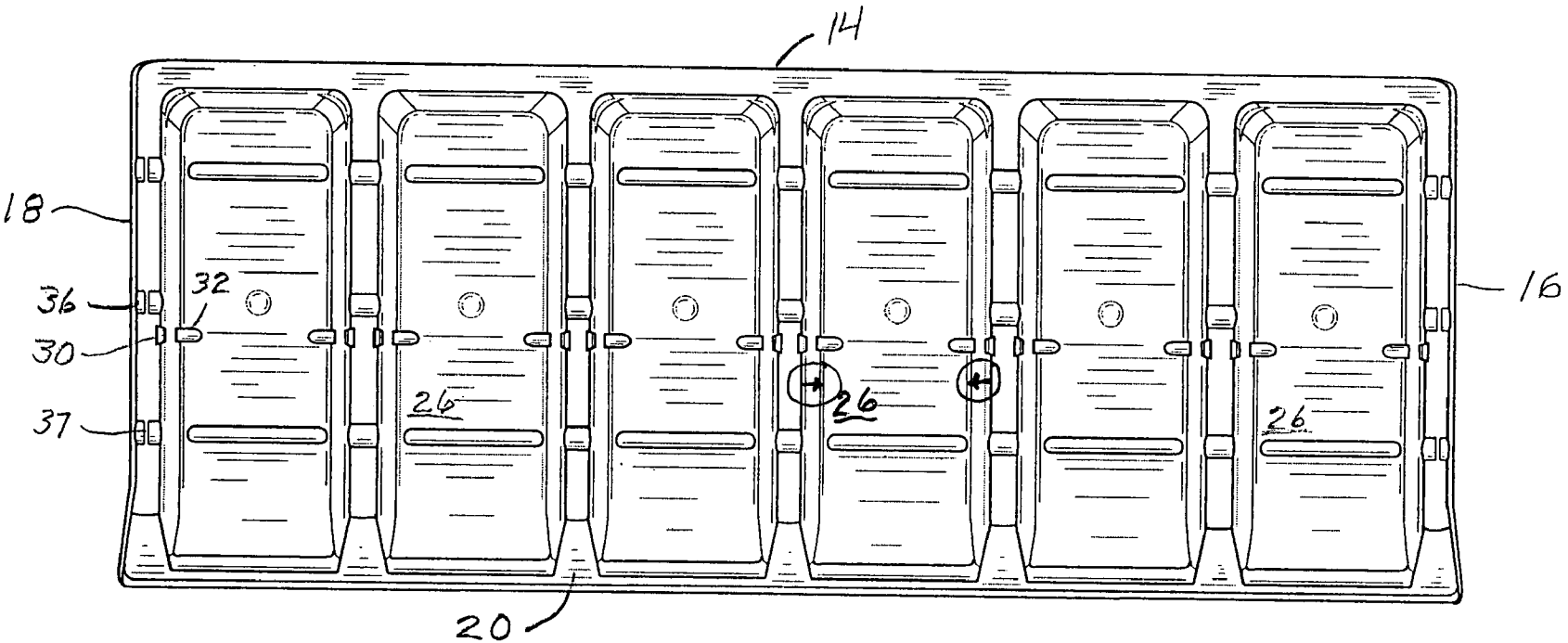
FIG. 4 is a top plan view of a system bin according to the present invention.
Figure 5:
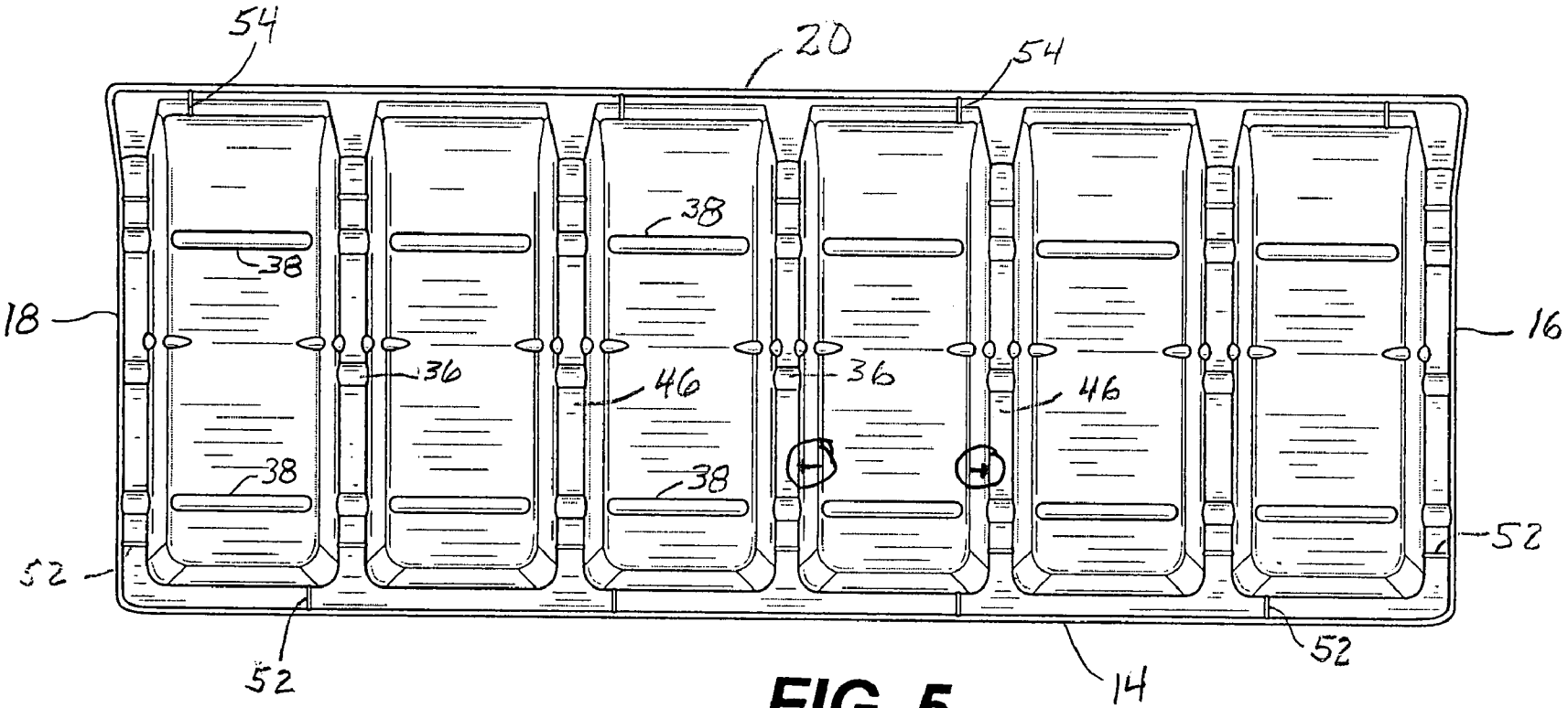
FIG. 5 is a bottom plan view of a system bin according to the present invention.

The top of each divider wall 24 and the top of each end wall 16 and 18 are provided with a plurality of spaced, aligned notches 36. As shown in FIG. 1B, each notch 36 in an end wall is provided with a retainer wall 37 therein. Moreover, as clearly shown in FIG. 5, the underside of the bottom of each compartment is provided with a pair of spaced grooves 38. The grooves 38 in each compartment are aligned longitudinally with grooves in other compartments across the bottom of the bin and are vertically aligned with the notches 36 in the tops of the end walls and divider walls. As shown in the drawings, a first set of aligned notches 36 is located adjacent the rear wall of the bin and a second set of aligned notches 36 is located near the front of the bin. Moreover, as shown in FIGS. 4 and 5, a first set of grooves 38 is provided on the bottom of each of the compartments adjacent the rear of the bin and a second set of aligned grooves is provided on the bottom of the compartments adjacent the front of the bin. The sets of grooves 36 are in vertical alignment with the sets of notches 34.

As shown in FIGS. 1A and 1B when two bins are placed in stacked relation, a pair of dowels 40 are received in the notches 36 of a lower bin and are received in the grooves 38 of an upper bin. The retainer wall 37 in each end wall notch 36 retains a dowel in place by preventing the dowel from moving or sliding outwardly of each end wall notch. Each dowel is cut to a length to just fit between the retainer wall of two notches in opposing end walls. The dowels provide an economical and secure way of stacking two or more identical bins on top of each other to form a system of bins.

Figure 3:
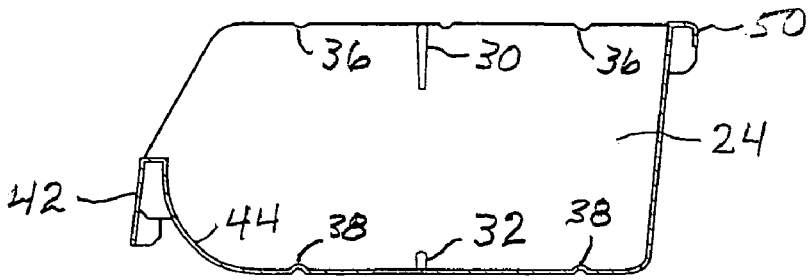
FIG. 3 is a cross-sectional view taken along line 3-3 of FIG. 1A.

The front wall 20 of each bin is provided with a flat surface 42 as shown in FIG. 3 so that labels or other indices may be applied adjacent the front of each compartment. The front wall of each bin is lower in height than the rear wall to provide easier access to each compartment. Moreover, as also shown in FIG. 3, each compartment curves upwardly at front portion 44 so that articles within the compartment may be easily removed therefrom. Front portion 44 also may be angled upwardly rather than curved.

Each divider wall 24 has a hollow interior 46 as shown in the bottom plan view of FIG. 5. The hollow interior is wider at the bottom and narrower at the top so that the side walls of each of the compartments slope inwardly from the top down to the bottom. This construction is advantageous in permitting nesting of two identical bins since the tops of the divider walls of a lower bin fit snugly within the hollow space 46 of an upper bin. When two bins are to be nested together, the dowels 40 are removed and stored separately.

In addition, each bin is provided with an outer rim 50 at the top thereof which extends around the ends and rear of the bin. Positioned under the rim at spaced locations on the end walls and the rear wall are a plurality of flanges 52 which contact the end walls and rear wall of a lower container when two containers are nested together. Similarly, flanges 54 are provided behind the front wall which contact the upper edge of the front wall of a lower bin when two bins are stacked together.

Figure 2:
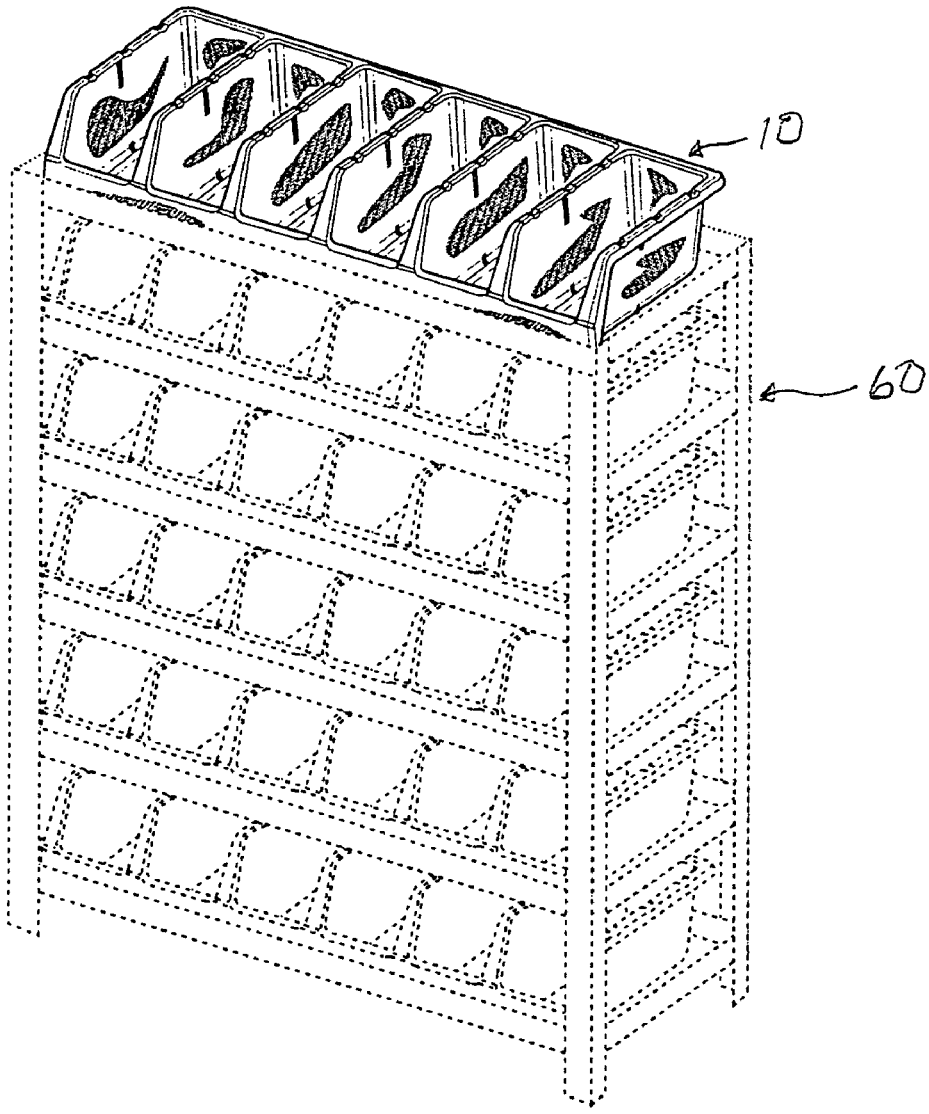
FIG. 2 is a perspective view showing a plurality of bins contained on a set of shelves.

The system bins of the present invention are also convenient to be stacked on a set of shelves 60 as shown in FIG. 2. The spacing of the shelves shown in FIG. 2 is only sufficient to support one bin on each shelf. When shelves having a larger spacing therebetween are employed, two or more bins may be stacked together and put on each shelf.

The present invention is advantageous in may respects. The use of dowels to stack two or more identical bins together provides an economical and secure way of safely stacking the bins. Moreover, each bin contains a plurality of separate compartments for organizing and storing different items. When the dowels are not used to separate two stacked bins, the construction of the bottom of the compartments of each bin are such that each compartment of an upper bin nests within a compartment of a lower bin to conserve space when the bins are nested together for storage or shipment. The provision of fixed or removable partition walls within each compartment also increases the utility of each system bin.

Numerous other modifications and adaptations of the present invention will be apparent to those skilled in the art and thus, it is intended by the following claims to cover all such modifications and adaptations which fall within the true spirit and scope of the invention.

What is claimed is:

1. A system bin comprising:

a bottom having a rear wall, first and second opposed end walls and a front wall connected thereto;

a plurality of spaced divider walls extending between said front and rear walls to form a plurality of compartments;

at least two sets of longitudinally aligned notches formed in a top of each of said divider walls and a top of each of said end walls; and at least two sets of longitudinally aligned grooves formed in undersides of said compartments, said grooves being in vertical alignment with said two sets of notches; and wherein said notches receive a pair of longitudinally extending dowels which support an upper system bin of identical construction when said upper system bin is in stacked relation on said system bin and said grooves receive a pair of dowels positioned in notches on a lower system bin of identical construction when said system bin is in stacked relation on said lower system bin.

2. A system bin according to claim 1 wherein said front wall is lower in height than said rear wall to provide access to said compartments.

3. A system bin according to claim 1 wherein at least one of said compartments includes slots in each divider wall thereof and a partition wall is mounted in said slots to divide said one compartment into a plurality of spaces.

4. A system bin according to claim 3 wherein said partition wall is removable.

5. A system bin according to claim 1 wherein each of said compartments is narrower at a bottom than at a top thereof.

6. A system bin comprising:

a bottom having a rear wall, first and second opposed end walls and a front wall connected thereto;

a plurality of spaced divider walls extending between said front and rear walls to form a plurality of compartments; and at least two sets of longitudinally aligned notches formed in a top of each of said divider walls and a top of each of said end walls;

at least two sets of longitudinally aligned grooves formed in a undersides of said compartments in vertical alignment with said two sets of aligned notches; and wherein said notches receive a pair of dowels which support an upper system bin of identical construction when said upper system bin is stacked relation on said system bin and said grooves receive a pair of dowels positioned in notches on a lower system bin of identical construction when said system bin is in stacked relation on said lower system bin; and wherein each said notch formed in said end walls has a retainer wall therein which prevents a dowel positioned in said notch from sliding longitudinally outwardly of said notch.

7. A system bin according to claim 6 wherein at least one of said compartments includes slots in each divider wall thereof and a partition wall is mounted in said slots to divide said one compartment into a plurality of spaces.

8. A system bin according to claim 7 wherein said partition wall is removable.

9. A system bin according to claim 6 wherein said front wall is lower in height than said rear wall to provide access to said compartments.

10. A system bin according to claim 6 wherein each of said compartments is narrower at a bottom than at a top thereof.

11. A system of bins comprising:

an upper bin and a lower bin;

each said bin including:

a bottom having a rear wall, first and second opposed end walls and a front wall connected thereto;

a plurality of spaced divider walls extending between said front and rear walls to form a plurality of compartments;

at least two sets of longitudinally aligned notches formed in a top of each of said divider walls and a top of each of said end walls;

at least two sets of longitudinally aligned grooves in undersides of said compartments, said grooves being in vertical alignment with said two sets of notches; and a pair of longitudinally extending dowels received in said notches formed in a top of each of said end walls of said lower bin and in said grooves formed on an underside of said compartments adjacent said first and second end walls.

12. A system of bins according to claim 11 wherein each said notch formed in said end walls has a retainer wall therein which prevents a dowel positioned in each said notch from sliding longitudinally outwardly of said notch.

13. A system of bins according to claim 12 wherein at least one of said compartments includes slots in each side wall thereof and a partition wall is mounted in said slots to divide each compartment into a plurality of spaces.

14. A system of bins according to claim 13 wherein each said partition wall is removable.

* * * * *